US006055905A

United States Patent [19]

Lemaster

[11] Patent Number: 6,055,905

[45] Date of Patent: May 2, 2000

[54] DUAL AIR CURTAIN APPARATUS FOR REDUCING INFILTRATION OF DAMPENING SOLUTION IN A LITHOGRAPHIC PRINTING PRESS

[76] Inventor: Milton R. Lemaster, 16528 Westgrove, Dallas, Tex. 75248

[21] Appl. No.: 09/377,319

[22] Filed: Aug. 19, 1999

[51] Int. Cl.[7] ..... B41M 1/10

[52] U.S. Cl. ..... 101/170; 101/141; 101/349.1

[58] Field of Search ..... 101/141, 142, 101/147, 148, 349.1, 424.1, 483, 170

[56] References Cited

U.S. PATENT DOCUMENTS

| | | | |
|---|---|---|---|
| 2,676,536 | 1/1954 | Ste-Marie | 101/141 |
| 2,804,693 | 9/1957 | Brodie | 34/422 |
| 2,842,503 | 7/1958 | De Marchi | 101/349.1 |
| 2,972,299 | 2/1961 | De Marchi | 101/349.1 |
| 3,008,242 | 11/1961 | Sites et al. | 34/275 |
| 4,524,689 | 6/1985 | Lemaster | 101/141 |
| 4,718,344 | 1/1988 | Lemaster | 101/426 |
| 4,777,877 | 10/1988 | Lemaster | 101/426 |
| 4,809,606 | 3/1989 | Day et al. | 101/148 |
| 4,887,533 | 12/1989 | Lemaster et al. | 101/492 |

*Primary Examiner*—Christopher A. Bennett
*Attorney, Agent, or Firm*—Dennis T. Griggs

[57] ABSTRACT

Separate air curtains of low pressure, high flow volume air are discharged onto the leading inking form roller on the feeder side and onto the trailing inking form roller on the delivery side of the plate cylinder to evaporate water entrained with the ink and which has migrated from the printing plate to the inking form rollers as a result of uneven application of water to the plate cylinder. A pair of elongated distribution manifolds are mounted on the press in proximity to the inking form rollers, one manifold directing a curtain of air onto the inking form roller and adjacent vibrator roller on the feeder side, and the other manifold directing a curtain of air onto the inking form roller and adjacent vibrator roller on the delivery side of the plate cylinder. Gap streak caused by periodic interruption in the transfer of dampening solution to the printing plate is eliminated by the dual air curtains which evaporate dampening solution picked up from the printing plate by the inking form rollers before the excess dampening solution has an opportunity to infiltrate the inking roller train.

10 Claims, 2 Drawing Sheets

DUAL AIR CURTAIN APPARATUS FOR REDUCING INFILTRATION OF DAMPENING SOLUTION IN A LITHOGRAPHIC PRINTING PRESS

BACKGROUND OF THE INVENTION

The present invention relates generally to offset printing presses, and in particular to method and apparatus for reducing infiltration of dampening solution in the inking system of a printing press.

In lithographic printing, a web printing press utilizes a plate cylinder, a lithographic printing plate, a blanket cylinder. The printing plate surface is chemically treated to form mutually exclusive ink receptive areas and ink repellant areas. Ink is transferred to the printing plate by an inking roller train.

The lithographic plate surface has non-image areas which are hydrophilic (wettable by water) and also has image surface areas which are oleophilic (wettable by ink). The wettable surfaces of the lithographic plate are completely wetted with a water film (a dampening solution) applied by dampening rollers, and a lithographic oil-based ink is then applied to the printing plate by inking rollers. The hydrophobic oil-based ink is rejected by the hydrophilic surface areas that are wetted by aqueous dampening solution. This produces an inked image on the oleophilic surface of the printing plate which is then transferred to the surface of an ink receptive blanket, which transfers (offsets) the inked image onto a substrate, for example a paper web.

In lithographic printing processes, printing ink is supplied from a reservoir or fountain by an ink ductor roller which transfers ink to the inking roller train, which in turn transfers it to the printing plate. The inking roller train includes storage rollers for milling the ink to obtain a desired fluidity, vibrator rollers which reciprocate axially to distribute the printing ink uniformly, idler storage rollers, bridging rollers and form rollers which apply the milled ink to the printing plate.

Dampening solution is supplied from a reservoir or fountain by a dampener roller train which transfers it to the printing plate. The dampener roller train typically includes a pan roller, a water transfer roller, a dampening form roller and one or more distribution rollers. The dampener roller train is installed on the rear (feeder) side of the plate cylinder and operates in parallel with the inking roller train.

In lithographic printing, the inking form rollers in contact with the printing plate pick up some of the dampening solution from the plate and transfer some of it to other rollers in the inking roller train. The infiltration of dampening solution into the inking roller system adversely affects the printed image by causing image defects known in the printing trade as "wash-out" and "ghosting." Excess dampening solution also reduces the color intensity of the ink, makes the ink less scratch resistant and retards drying of the ink.

Planographic printing processes including lithographic printing are widely used for producing a myriad of printed materials and in particular in multicolor printing. In the basic process of lithographic printing, an aqueous dampening solution is applied to the plate cylinder in order to prevent the deposition of ink on the printing plate in the areas where no image is wanted. Conventional lithographic printing presses utilize a relatively complex system of inking rollers to distribute the ink evenly across the plate cylinder. The printing plate must, of course, also be in contact with a dampener system which normally includes a set of dampener rollers engaged with the printing plate at a location on the feeder side of the plate cylinder which is generally diametrically opposite to the inking form rollers. However, inevitably, the inking form rollers in contact with the printing plate pick up some of the water from the printing plate, and the water then infiltrates through the inking roller train.

DESCRIPTION OF THE PRIOR ART

The cause of ghost imaging in lithographic printing and the subtle discoloration caused by the presence of water in various colored inks has been little understood. Attempts have been made to eliminate image wash-out and maintain good color intensity by changing the ink composition and by reducing the amount of dampening solution applied to the printing plate. However, if the dampening solution is reduced too much, the non-image areas of the plate will start to pick-up ink and images will appear where they are not wanted. A careful balance must be maintained between the ink and the amount of dampening solution applied to the surface of the printing plate. Too much dampening solution causes color wash-out, retards the drying of the ink and also causes ink emulsification. Insufficient dampening solution causes the non-image areas of the printing plate to pick-up ink (scumming) and to print in non-image areas, also causing dot gain.

One method for removing excessive dampening solution from the inking roller train of lithographic printing presses employs forced air equipment, as disclosed in my U.S. Pat. No. 4,524,689. Air jets are directed from an air distribution manifold onto the intermediate ink transfer rollers in the inking roller train on the delivery side of the plate cylinder in an effort to evaporate the infiltrated dampening solution and thus dehydrate the ink transferred to the inking form rollers. A single air bar or manifold is mounted on the delivery side of the plate cylinder externally of the inking roller train and produces a curtain of pressurized air that is applied only to the intermediate inking transfer rollers on the delivery side.

Because of the bridging or clustered geometry of the inking roller train, airflow directed onto the intermediate rollers cannot reach the inking form rollers that are in contact with the plate on the delivery side, and also cannot penetrate or circulate effectively through or around the inking roller train, and thus cannot reach any of the rollers located on the feeder side of the inking roller train. Also, ink misting generated due to milling of the ink and excess dampening solution accumulate on the inking form rollers and thus alter the ink fluidity and tack. The image defects become increasingly more prevalent since heat build-up, ink misting and dampening solution infiltration increase at higher press speeds.

BRIEF SUMMARY OF THE INVENTION

The present invention provides an apparatus and method for reducing the infiltration of dampening fluid in the inking system of web and sheet-fed lithographic printing presses. With the discovery of the present invention substantial improvements have been realized in the quality of printed material obtainable with single and multicolor lithographic printing processes.

I have discovered the source of a serious image problem that is directly related to the periodic interruption in the transfer of dampening solution to the printing plate. In particular, I have discovered that in addition to wash-out, an image defect which I refer to as "gap streak" is caused by the periodic accumulation of an excessive amount of dampening solution on the dampener form rollers as the plate mounting recess or anchor pocket of the plate cylinder periodically traverses the dampener form rollers. The plate mounting pocket is a non-contacting region or recess formed radially within the plate cylinder for receiving the end portions of the printing plate and plate anchor clamps.

As a result of this plate discontinuity or non-contacting region, an increased amount of dampening solution temporarily accumulates on the dampener rollers as the anchor pocket moves across the dampener rollers. The excessive dampening fluid accumulating on the dampener form rollers is subsequently transferred to the printing plate as the plate cylinder turns and the image plate area is re-engaged. The result is a sudden increase in the amount of dampening solution applied to the image areas, thus causing a "gap streak" or a localized "washed-out" area on the printed image.

In accordance with one aspect of the present invention, these problems are overcome by dual curtains of pressurized air which are separately discharged over the inking rollers on the feeder side and on the delivery side, respectively, of the inking roller train to at least partially evaporate the moisture picked up by the inking rollers, and thereby moderate the effect of periodic variations in the amount of dampening solution applied by the dampener rollers over the printing plate.

The apparatus of the present invention includes a pair of air distribution manifolds which are mounted in parallel with the plate cylinder and generally adjacent to the leading (feeder) side and the trailing (delivery) side of the inking system of a lithographic press. In the preferred embodiment, the manifolds include multiple nozzles which discharge dual curtains of low pressure, high volume air or other dry gas over the leading and trailing inking form rollers, respectively, that are in contact with the plate.

I have discovered that excess moisture is applied to the printing plate and subsequently to the inking form rollers as a result of the accumulation of an excess amount of dampening solution on the dampener rollers during the time that the dampening form rollers are facing the plate mounting pocket and are not being contacted by the printing plate. The excess amount of dampening solution is substantially evaporated by the dual air curtains, thus reducing or moderating infiltration of dampening solution. Preferably, the dual air curtains are discharged into the nip between the leading inking form roller and an adjacent vibrator roller on the feeder side and into the nip between the trailing inking form roller and an adjacent vibrator roller on the delivery side of the plate cylinder.

The dual air curtain manifolds are directed toward the inking form rollers on the leading (feeder) side and on the trailing (delivery) side adjacent the plate cylinder and are supplied with pressurized air from a source such as a low pressure blower through a supply manifold. The operation of the dual air curtain moderating system is preferably controlled in conjunction with operation of the inking system to prevent unwanted drying of the rollers when the press is momentarily stopped or otherwise not applying ink to the printing plate through the inking rollers.

According to another aspect of the present invention there is provided a method for moderating the infiltration of dampening fluid in the inking roller train of a lithographic printing press by evaporating a substantial portion of the excess moisture before it has an opportunity to infiltrate the inking roller system. I have discovered that by applying separate curtains of pressurized air at relatively low pressure and high volume onto the inking form roller on the leading (feeder) side and onto the inking form roller on the trailing (delivery) side of the plate, that poor quality printing and image defects associated with contamination of the ink with water are substantially eliminated.

Moreover, inking roller cooling and removal of heat and volatiles such as ink mist, odors, dampening solution and moisture vapors are achieved according to the present invention by first and second air curtain assemblies which are mounted externally on opposite sides (delivery and feeder) of the plate cylinder. Jets of cooling air are discharged from the air distribution manifolds and impinge onto adjacent inking form rollers or into the nip between adjacent inking form rollers and vibrator rollers on opposite sides (feeder and delivery) of the inking roller train. The jets of cooling air flow in heat transfer contact with the clustered rollers on opposite sides of the plate cylinder. Heat, ink mist, excess dampening solution vapors and printing ink volatiles are entrained with the cooling air as it flows in contact with the rollers. As a result, heat, ink volatiles, odors and dampening solution vapors are carried away from the inking roller train and away from the press, which would otherwise accumulate within the inking roller train/dampener compartment of the press.

Because ambient air at press room temperature, for example 75° F. (24° C.) or conditioned cooling air at a predetermined controlled temperature, is discharged across the inking roller train, the mechanical parts of the printing unit and the inking roller train, including gears, bearings, vibrator rollers and drive rollers are also cooled and maintained substantially at ambient press room temperature. This extends the service life of those mechanical and electrical components and eliminates the need for chill rollers.

Those skilled in the art will appreciate the abovenoted advantages of the present invention as well as other superior aspects thereof upon reading the detailed description which follows in conjunction with the drawings.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
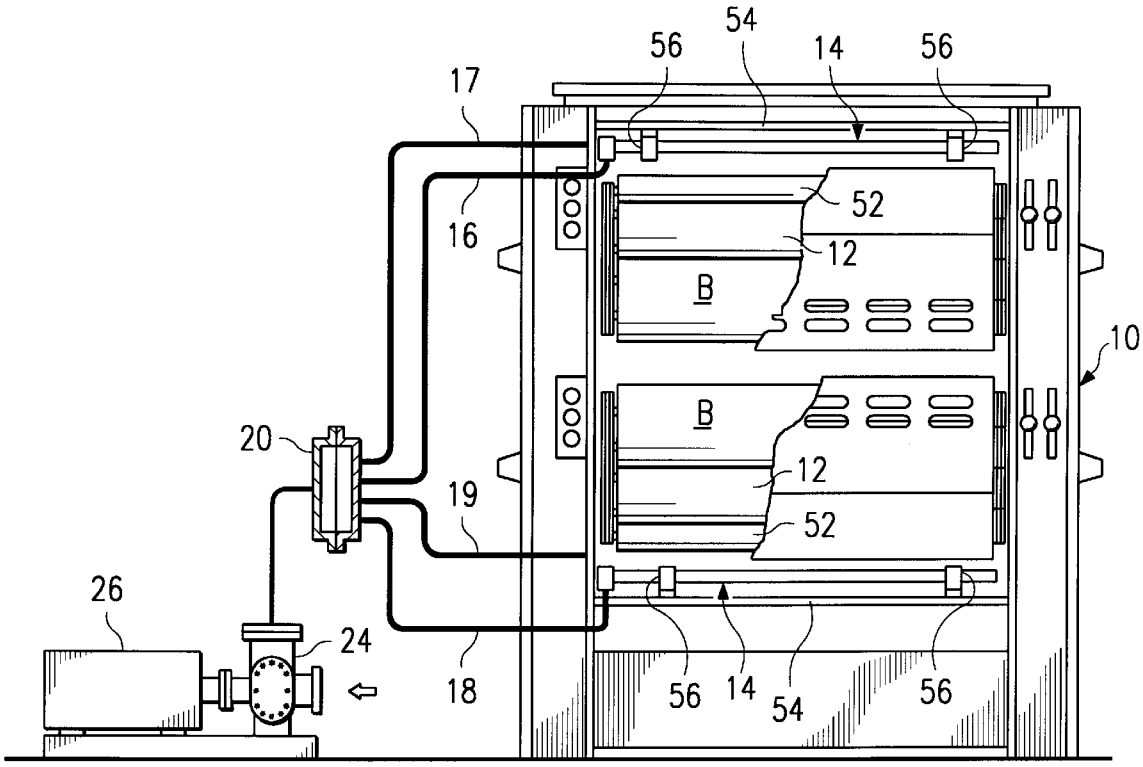
FIG. 1 is a schematic illustration of the moderating system of the present invention in use on a web printing press.

Preferred embodiments of the invention will now be described with reference to various examples of how the invention can best be made and used. Like reference numerals are used throughout the description and several views of the drawing to indicate like or corresponding parts.

Referring to FIG. 1, there is illustrated a schematic diagram of a dual air curtain moderating system constructed in accordance with the present invention. The system of the present invention is adapted to be used on lithographic printing presses such as a "one-over-one" web press generally designated by the numeral 10. The web press 10 includes two printing units of the offset type, each including a plate cylinder 12 and a blanket cylinder B.

Figure 2:
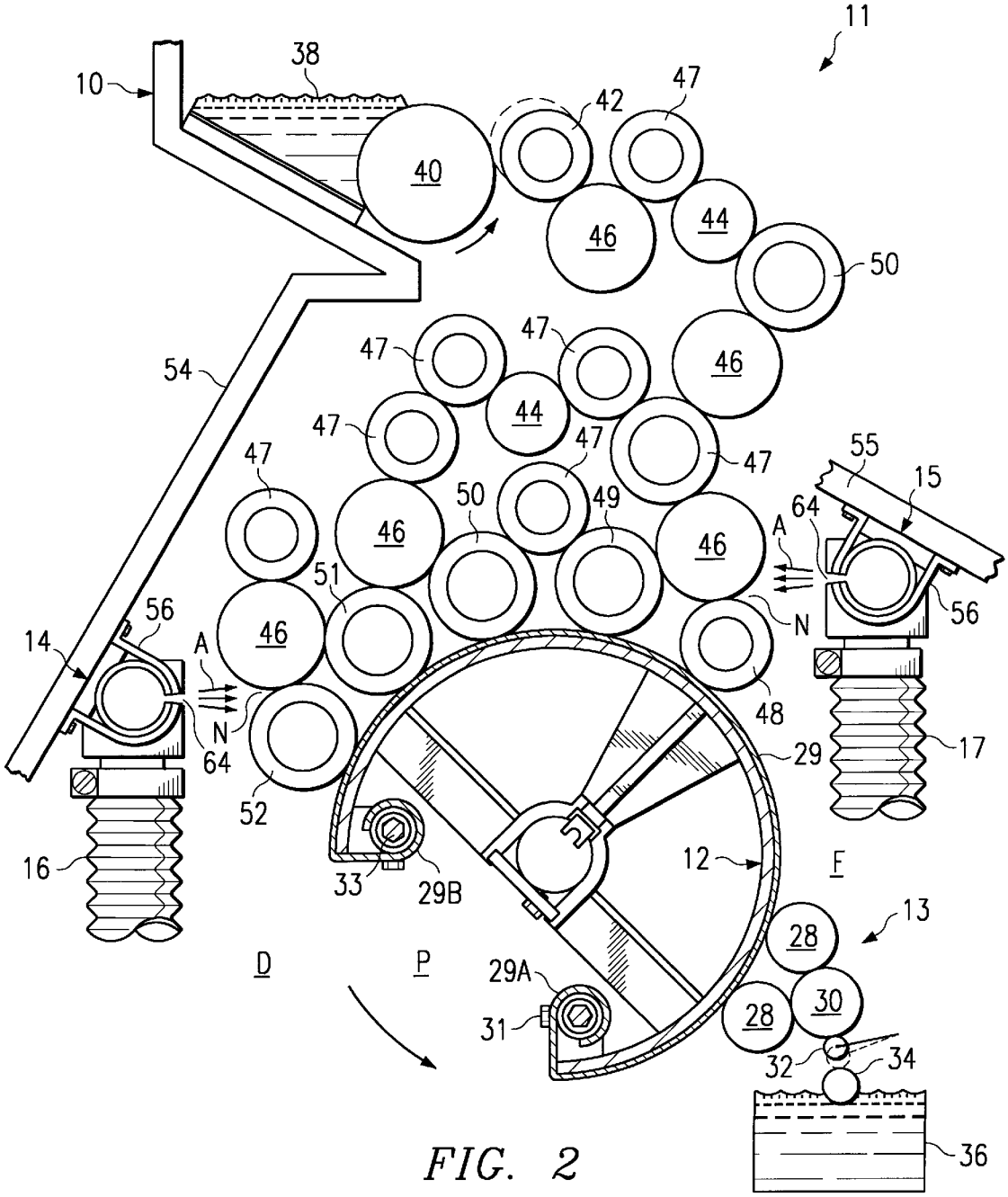
FIG. 2 is a schematic side elevation of the inking/dampening roller system of one stage of the web printing press of FIG. 1 showing the general location of the dual air distribution manifolds arranged according to the present invention; and, FIG. 3 is a longitudinal plan view of one of the air distribution manifolds showing the arrangement of the air outlet orifices.

Each plate cylinder 12 is provided with an inking roller system 11 and a moistening (dampener) roller system 13 of the type to be described herein in conjunction with FIG. 2. In accordance with the present invention, it has been discovered that the problems identified with contamination of the inking roller system 11 with water or dampener fluid picked up from the printing plate can be effectively eliminated by providing dual pressurized air distribution manifolds, such as the manifolds designated by the numerals 14, 15 for each printing unit of the web press 10. The manifolds 14, 15 are preferably arranged in relation to the inking roller system 11 of each web printing unit to direct separate high velocity streams or curtains of low pressure, high volume (cfm) air A toward the inking distribution rollers, preferably on the leading and trailing inking form rollers in contact with the printing plate on the feeder side F and on the delivery side D of the plate cylinder, respectively, as shown in FIG. 2.

Referring to FIG. 1, the air distribution manifolds 14, 15 installed adjacent the upper web printing unit are supplied with pressurized air through respective delivery conduits 16, 17 which are connected in air flow communication with a supply manifold generally designated by the numeral 20. Similarly, a second set of air distribution manifolds 14, 15 installed below the lower web printing unit are supplied with pressurized air through respective delivery conduits 18, 19 which are also connected in communication with the supply manifold 20. The supply manifold 20 is connected to a source of pressurized air such as a compressor or blower 24 driven by a suitable electric motor or other prime mover 26. The blower 24 may be selected from one of several types adapted for relatively low pressure, high volume service such as a centrifugal or lobe type blower. A typical example of a low pressure, high volume (cfm) blower suitable for a lithographic web press having 40 inch sheet width capability is the 200 Series blower manufactured by Lamson Corporation, Syracuse, N.Y., delivering approximately 200 cfm at 4 psig discharge pressure.

Referring now to FIG. 2, there is illustrated in simplified schematic form the general arrangement of an inking roller system 11 for applying ink to a printing plate 29 on one of the plate cylinders 12 of the press 10 referenced in FIG. 1. The inking roller train 11 illustrated in FIG. 2 is exemplary in the sense that it will be understood that the dual air curtain moderating system and method in accordance with the present invention can be used in conjunction with the inking roller systems of various lithographic and other planographic presses, including sheet-fed presses.

Referring again to FIG. 2, a moistening (dampening) roller system 13 includes rollers 28 which are in direct engagement with the image surface of a printing plate 29 on the plate cylinder 12 and are supplied with water from a common distribution roller 30 which is engaged with an oscillating feed roller 32 which oscillates between the roller 30 and a supply roller 34 which is at least partially immersed in a water reservoir 36.

The inking roller system 11 includes a source of ink such as a fountain 38, a fountain roller 40, an oscillating feed roller 42, a series of vibrator rollers 44, 46, a system of composition rollers 47, a series of form rollers 48, 49, 50, 51 and 52, all of which form a feeding and distribution system for ink to be applied to the image surface of the printing plate 12.

In conventional lithographic printing presses the application of water or dampening fluid to the surface of the plate cylinder by the moistening roller system 13 is not controlled precisely enough to prevent some accumulation of water on the ink distribution form rollers. This pickup of water on the inking form rollers 49, 50, 51 and 52 results in additional migration or infiltration of the water through the inking roller system 11. The result of this accumulation and migration of water is an uneven distribution of ink, a development of secondary or "ghost" images on the printed material, and dilution of the ink to the extent that the color intensity may be affected.

I have discovered that in addition to wash-out and ghosting, an additional image defect which I refer to as "gap streak" is caused by the periodic accumulation of an excessive amount of dampening solution on the dampener form rollers 13 as the plate mounting recess or anchor pocket P of the plate cylinder 12 periodically moves across the dampening form rollers 28.

Referring to FIG. 2, the plate mounting pocket P is a non-contacting region or recess formed radially within the plate cylinder 12 for receiving the plate end portions 29A, 29B which are secured and tensioned within the pocket P by anchor clamps 31, 33, respectively. Since the printing plate 29 does not extend across the anchor pocket P, the dampening solution supplied by the distribution roller 30 accumulates on the dampener rollers 28 during the short non-contacting transit interval as the plate cylinder 12 completes each revolution. This extra dampening fluid which temporarily accumulates on the dampening rollers is subsequently transferred to the printing plate by the dampener distribution rollers 28 as the image area of the printing plate 29 is re-engaged during the next revolution. This causes a sudden increase or surge in the volume of dampening solution applied to the plate image areas, thus causing a "gap streak" or a localized "wash-out" area on the printed image.

The anchor pocket P separates the ends 29A, 29B of the printing plate and thus presents a void which cannot receive or transfer dampener solution, which is the cause of "gap-streak" or localized wash-out. Instead of attempting to evaporate the dampening solution after it has infiltrated the intermediate rollers of the inking roller train according to conventional practice, I have discovered that localized "wash-out" and "gap streak" image defects can be effectively eliminated by evaporating the excessive dampener solution at the leading and trailing form rollers (that are in contact with the plate) before the dampening solution infiltrates the bridging intermediate rollers of the inking roller train.

This is accomplished by the dual air curtain arrangement of the present invention in which low pressure, high volume air curtains are discharged onto the leading and trailing inking form rollers 48, 52 on the feeder side F and on the delivery side D of the inking roller train 11. The anchor pocket P and the transfer discontinuity it presents to the dampener rollers 28 is a significant cause of the uneven distribution of dampener solution. The effect of the periodic variation in dampener fluid volume is effectively de-coupled from the inking roller train by evaporation of the excess dampening solution at the leading and trailing inking form rollers 48, 52.

As illustrated in FIG. 2, the dual air curtain manifolds 14, 15 are supported on frame portions 54 and 55 of the press 10, for example, by means of band clamps 56, as shown in FIG. 2. The clamps 56 may be selectively tightened to secure each manifold 14, 15 in a predetermined rotative position with respect to its longitudinal central axis to direct the stream of pressurized air A toward the inking form rollers. Further, in accordance with the present invention, it has been determined that by discharging the air curtains onto the leading inking form roller 48 and onto the trailing inking form roller 52 immediately in contact with the printing plate 29, the problems caused by infiltration of dampening solution into the inking roller train 11 are substantially eliminated.

Preferably, the air curtains produced by the manifolds 14, 15 are discharged into the nip N that is formed between the leading inking form roller 48 and adjacent vibrator roller 46 on the feeder side F of the plate cylinder, also into the nip N which lies between the trailing inking form roller 52 and the adjacent vibrator roller 46 on the delivery side D of the plate cylinder 12. The low velocity, high volume air curtains A flow into the nip regions N, and flow over the inking form rollers and adjacent vibrator rollers, thus evaporating the dampener solution which has been picked up from the printing plate 29.

Figure 3:
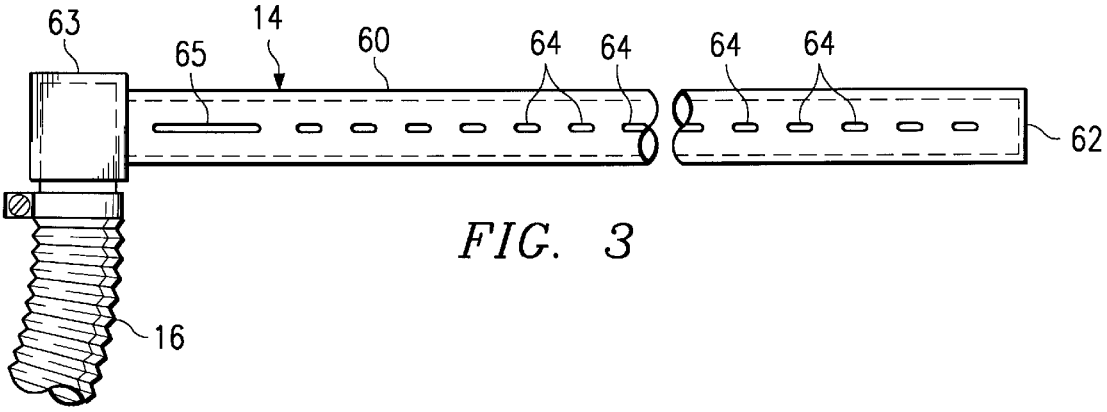

Referring now to FIG. 3, there is illustrated a preferred form of the air distribution manifolds 14, 15, with each manifold being constructed in the form of an elongated cylindrical tubular conduit 60 having a closed end 62 and a fitting 63 formed at the opposite end for connecting the manifold to the supply conduit 16. In installations for retrofitting existing presses the supply conduit 16 is preferably a flexible wire reinforced plastic hose or comparable type which facilitates installation and minimizes installation time and plumbing work. Moreover, the retrofitting of existing presses also results in the preferred arrangement wherein the distribution manifold tube 60 is supplied with pressurized air from one end as illustrated.

It is, of course, desirable to provide a relatively even distribution of airflow over the entire length of the inking roller system 11 and in this regard it has been determined that a series of spaced apart somewhat elongated orifices 54 should be provided in a pattern as indicated generally by the arrangement illustrated in FIG. 3. However, it has also been determined that, in order to provide uniform air flow distribution from a manifold wherein the air is supplied to the manifold at one end thereof, one of the orifices should be relatively longer or of greater cross-sectional flow area.

For example, the orifice 65 directly adjacent to the inlet fitting 63 is approximately six times the cross-sectional flow area of the remaining orifices 54. In a typical example for use in conjunction with a 40 inch or 60 inch press the configuration of the tubular conduit 60 is a thin walled steel tube of nominal 1.125 inches diameter having a plurality of orifices 64 of 0.250 inches length by 0.062 inches width and spaced apart at 0.50 inch intervals along the length of the conduit. The inlet pressure equalization orifice 65 is approximately 1.50 inches length by 0.062 width.

The installation and operation of the dual air curtain moderating system described and illustrated in conjunction with the drawing figures is believed to be readily understandable by those skilled in the art. Air is preferably supplied to the dual distribution manifolds 14, 15 at all times during operation or rotation of the plate cylinder and the inking roller system. In this regard, the motor 26 is controlled to drive the blower 24 during press operation or, alternatively, the flow of air through the supply conduits 16, 18 may be redirected during times when the press is shut down. Other forms of control of air flow in relation to press operation will also be apparent to those skilled in the art of fluid power distribution systems.

Although a preferred embodiment of the invention has been described herein, those skilled in the art will also appreciate that various substitutions and modifications may be made to the specific arrangement described without departing from the scope and spirit of the invention as recited in the appended claims.

I claim:

1. A method for reducing the infiltration of dampening moisture into the inking roller train in a printing press of the type including a plate cylinder, a printing plate mounted on the plate cylinder and a train of inking rollers engagable with the printing plate between the feeder side and the delivery side of the plate cylinder, comprising the steps:

discharging air onto one or more inking rollers on the feeder side of the plate cylinder; and, discharging air onto one or more inking rollers on the delivery side of the plate cylinder.

2. A method for reducing the infiltration of dampening moisture as set forth in claim 1, the inking roller train including a leading form roller and a trailing form roller disposed for contact with the printing plate, including the steps:

discharging air onto the leading form roller on the feeder side of the plate cylinder; and, discharging air onto the trailing form roller on the delivery side of the plate cylinder.

3. A method for reducing the infiltration of dampening moisture as set forth in claim 1, including the steps:

discharging air into the nip between adjacent inking rollers on the feeder side of the plate cylinder; and, discharging air into the nip between adjacent inking rollers on the delivery side of the plate cylinder.

4. A method for reducing the infiltration of dampening moisture as set forth in claim 1, wherein the inking roller train includes a leading form roller and a trailing form roller disposed for contact with the printing plate and first and second vibrator rollers engaging the leading and trailing form rollers, respectively, including the steps:

discharging air into the nip between the leading form roller and the adjacent vibrator roller on the feeder side of the plate cylinder; and, discharging air into the nip between the trailing form roller and the adjacent vibrator roller on the delivery side of the plate cylinder.

5. A method for reducing the infiltration of dampening moisture into the inking roller train in a printing press of the type including a plate cylinder, a printing plate mounted on the plate cylinder and a train of inking rollers including a leading form roller and a trailing form roller engagable with the printing plate between the feeder side and the delivery side of the plate cylinder, comprising the step:

discharging air onto the leading form roller on the feeder side of the plate cylinder.

6. A method for reducing the infiltration of dampening moisture as set forth in claim 5, including the step:

discharging air into the nip between adjacent inking rollers on the feeder side of the plate cylinder.

7. A method for reducing the infiltration of dampening moisture as set forth in claim 5, wherein the inking roller train includes a vibrator roller engaging the leading form roller, including the step:

discharging air into the nip between the leading form roller and the adjacent vibrator roller on the feeder side of the plate cylinder.

8. Apparatus mountable on a printing press for reducing the infiltration of dampener fluid, the press including a frame and a rotatable plate cylinder mounted on the frame, and an inking system including a plurality of inking rollers engagable with a printing plate mounted on the plate cylinder and disposed between the feeder side and the delivery side of the plate cylinder, said apparatus comprising:

a first air distribution manifold disposed adjacent the inking rollers on the feeder side of the plate cylinder, the first air distribution manifold including one or more discharge orifices oriented for directing a flow stream of air onto one or more inking rollers on the feeder side of the plate cylinder; and, a second air distribution manifold disposed adjacent the inking rollers on the delivery side of the plate cylinder, the second air distribution manifold including one or more discharge orifices oriented for discharging a flow stream of air onto one or more inking rollers on the delivery side of the plate cylinder.

9. Apparatus mountable on a printing press for reducing the infiltration of dampener fluid, the press including a frame and a rotatable plate cylinder mounted on the frame, and an inking system including a train of inking rollers disposed adjacent the plate cylinder, the inking roller train including a leading form roller and a trailing form roller engagable with a printing plate on the plate cylinder and disposed between the feeder side and the delivery side of the plate cylinder, said apparatus comprising:

an air distribution manifold disposed adjacent the inking rollers on the feeder side of the plate cylinder, the air distribution manifold including one or more discharge orifices oriented for discharging a flow stream of air onto the leading form roller on the feeder side of the plate cylinder.

10. Apparatus for reducing infiltration as set forth in claim 9, wherein the inking roller train includes a vibrator roller disposed in engagement with the leading form roller, and one or more discharge orifices are oriented for discharging a flow stream of air into the nip between the leading form roller and the vibrator roller on the feeder side of the plate cylinder.

* * * * *